US006004710A

United States Patent [19]

Takagi et al.

[11] Patent Number: 6,004,710

[45] Date of Patent: Dec. 21, 1999

[54] ELECTROPHOTOGRAPHIC PHOTOSENSITIVE MEMBER, PROCESS CARTRIDGE, AND ELECTROPHOTOGRAPHIC APPARATUS

[75] Inventors: Noriyuki Takagi, Numazu; Noboru Kashimura, Shizuoka-ken; Kazushige Nakamura, Yokohama, all of Japan

[73] Assignee: Canon Kabushiki Kaisha, Tokyo, Japan

[21] Appl. No.: 09/021,068

[22] Filed: Feb. 9, 1998

[30] Foreign Application Priority Data

Feb. 12, 1997 [JP] Japan ..... 9-041382

[51] Int. Cl.[6] ..... G03G 5/147

[52] U.S. Cl. ..... 430/66; 399/297

[58] Field of Search ..... 430/66, 67; 399/297

[56] References Cited

U.S. PATENT DOCUMENTS

| | | | |
|---|---|---|---|
| 5,455,135 | 10/1995 | Maruyama et al. | 430/66 |
| 5,693,443 | 12/1997 | Nakamura et al. | 430/66 |

FOREIGN PATENT DOCUMENTS

| | | |
|---|---|---|
| 0 006 356 | 1/1980 | European Pat. Off. . |
| 0460558A1 | 12/1991 | European Pat. Off. . |
| 57-30843 | 2/1982 | Japan . |
| 3-246553 | 11/1991 | Japan . |

*Primary Examiner*—John Goodrow

*Attorney, Agent, or Firm*—Fitzpatrick, Cella, Harper & Scinto

[57] ABSTRACT

An electrophotographic photosensitive member is formed by disposing a photosensitive layer and a protective layer in this order on a support. The protective layer comprises an applied and cured product of the following solution (A) or (B); (A) a solution comprising a curable resin component and a polymerization initiator having a polymeric recurring structure, or (B) a solution comprising a curable resin component, a polymerization initiator free from a polymeric recurring structure and a polymerization initiator aid having a polymeric recurring structure. Because of the polymerization initiator or polymerization initiator aid having a polymeric recurring structure used for constituting the protective layer, the resultant photosensitive member can exhibit improved durability as well as good electrophotographic performances.

18 Claims, 1 Drawing Sheet

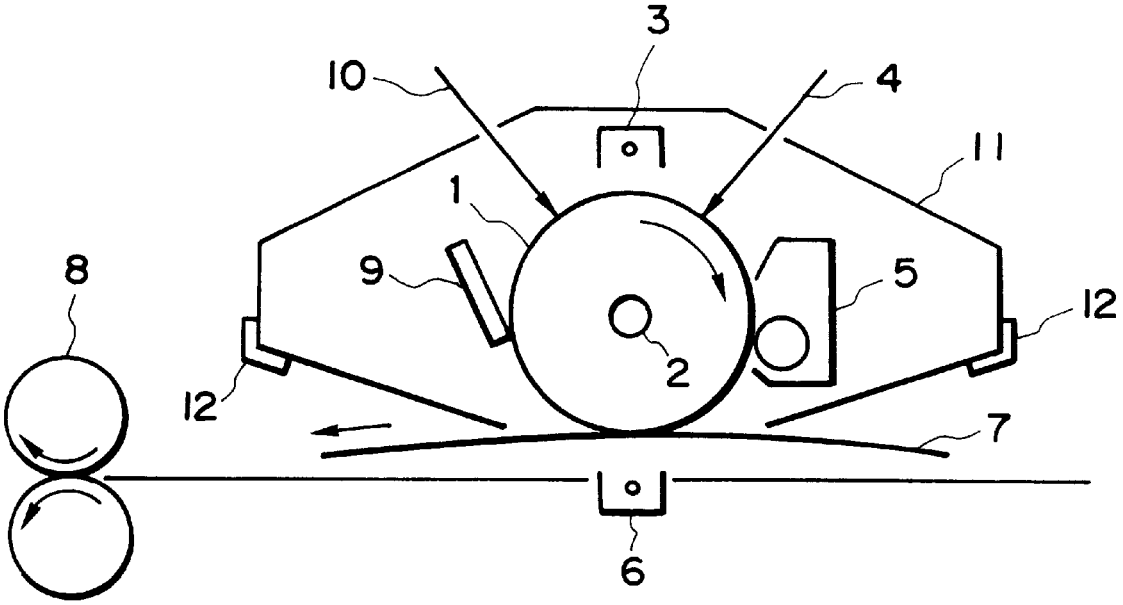
3
10
4
11
1
9
5
12
8
2
12
7
6

ELECTROPHOTOGRAPHIC PHOTOSENSITIVE MEMBER, PROCESS CARTRIDGE, AND ELECTROPHOTOGRAPHIC APPARATUS

FIELD OF THE INVENTION AND RELATED ART

The present invention relates to an electrophotographic photosensitive member, and more particularly an electrophotographic photosensitive member having a specific protective layer. The present invention also relates to a process cartridge and an electrophotographic apparatus including such a photosensitive member.

An electrophotographic photosensitive member is required to show prescribed levels of sensitivity, electrical properties and optical characteristics depending on an electrophotographic process to which the photosensitive member is applied. Particularly, the surface layer of a photosensitive member subjected to repetition of electrophotographic steps, and is directly supplied with electrical, mechanical and chemical forces during steps, such as charging, development, transfer and cleaning, thus requiring resistance to such forces. More specifically, the surface layer is required to exhibit resistance to surface wear or damage from rubbing, surface deterioration due to ozone occurring at the time of charging, etc. Further, the surface layer is required to cause little toner attachment, thus exhibiting an improved cleanability.

In order to provide a surface layer with such required properties, several proposals have been made to form a resinous surface protective layer on a photosensitive layer. For example, Japanese Laid-Open Patent Application (JP-A) 57-30843 discloses a protective layer having a suppressed resistivity by inclusion of electroconductive particles of a metal oxide. A principal effect thereof is to prevent an increase of residual potential in the photosensitive member during repeated use.

It has been also proposed to form a protective layer by application of a liquid composition comprising at least a curable monomer and a present invention, followed by drying and curing under application of light or heat, in order to provide a protective layer with an improved dispersibility of electroconductive particles, an improved hardness, and an improved cleanability (e.g., in JP-A 3-246553).

In view of demands for further improved image quality and durability, it has been desired to provide an electrophotographic photosensitive member satisfying the above-mentioned requirements at higher levels.

SUMMARY OF THE INVENTION

An object of the present invention is to provide an electrophotographic photosensitive member showing excellent durability against the occurrence of surface wear and/or damage due to rubbing, and also stable electrophotographic performances free from an increase in residual potential.

A further object of the present invention is to provide a process cartridge and an electrophotographic apparatus including such an electrophotographic photosensitive member.

According to the present invention, there is provided an electrophotographic photosensitive member, comprising: a support, and a photosensitive layer and a protective layer disposed in this order on the support, wherein the protective layer comprises an applied and cured product of the following solution (A) or (B):

(A) a solution comprising a curable resin component and a polymerization initiator having a polymeric recurring structure, or (B) a solution comprising a curable resin component, a polymerization initiator free from a polymeric recurring structure and a polymerization initiator aid having a polymeric recurring structure.

The present invention further provides a process cartridge and an electrophotographic apparatus including the above-mentioned electrophotographic photosensitive member.

These and other objects, features and advantages of the present invention will become more apparent upon a consideration of the following description of the preferred embodiments of the present invention taken in conjunction with the accompanying drawings.

BRIEF DESCRIPTION OF THE DRAWING

The sole FIGURE in the drawing is a schematic illustration of an electrophotographic apparatus including a process cartridge, which in turn includes an electrophotographic photosensitive member, to which the present invention is applicable.

DETAILED DESCRIPTION OF THE INVENTION

The electrophotographic photosensitive member according to the present invention comprises a support, a photosensitive layer and a protective layer disposed in this order, and the protective layer comprises a cured product of the following solution (A) or (B):

(A) a solution comprising a curable resin component and a polymerization initiator having a polymeric recurring structure, or (B) a solution comprising a curable resin component, a polymerization initiator free from a polymeric recurring structure and a polymerization initiator aid having a polymeric recurring structure.

Thus, the protective layer in the present invention may be formed by coating a photosensitive layer with a solution comprising a curable resin component, a polymerization initiator, and optionally a polymerization initiator aid, followed optionally by drying, and then curing the coating under application of light or heat, wherein at least one of the polymerization initiator and polymerization initiator aid (when used) has a polymeric recurring structure.

It has not been fully clarified as yet why the effect of the present invention can be obtained by the use of a protective layer formed as described above, but it is assumed that the use of a polymerization initiator and/or a polymerization initiator aid having a polymeric recurring structure is effective for preventing migration through the protective layer or exudation to the surface thereof during or after the formation of the protective layer because of the polymeric recurring structure, thus providing excellent durability and electrophotographic performances.

Herein, the term polymerization initiator refers to a compound capable of generating radicals under the application of an energy, such as light or heat, and a polymerization initiator aid is a compound capable of enhancing the ability of generating radicals of the polymerization initiator, i.e., increasing (or sensitizing) the sensitivity of a polymerization initiator to light, heat, etc., under the application of an energy, such as light or heat. This relationship can be a relative one, so that a single compound can function as a polymerization initiator or a polymerization initiator aid depending on the compound used in combination therewith.

In order to form the protective layer of the present invention at a high curing speed, it is preferred to use a photo-polymerization initiator and a photo-polymerization initiator aid.

In the case where the polymerization initiator or polymerization initiator aid has a polymeric recurring structure, the entire structure of such a compound may be roughly divided into a polymeric recurring structure portion, a polymerization initiator structure portion or polymerization initiator aid structure portion, and optionally a bonding group portion bonding these structure portions.

The polymeric recurring structure portion is a structure portion including a number of bonded recurring units formed by polymerization (in a sense of including "oligomerization") of a polymerizable group, and examples thereof may include: polymerized acrylic units (in a sense of including "methacrylic units"), liquid polybutadiene units, unsaturated polyester units and polyene-polythiol units. In the present invention, it is preferred to use a polymerization initiator or polymerization initiator aid having a polymerized acrylic unit in view of their reactivity and compatibility with a preferred class of curable resin components described hereinafter.

The polymerization initiator structure portion may be any structure portion capable of generating radicals upon the application of energy, such as light or heat, and may comprise a structure including an ordinary mono-molecular polymerization initiator with its atom used for bonding with another polymeric recurring structure or another bond group. Examples of such mono-molecular polymerization initiators providing such polymerization initiator structure may include: benzophenone, Michler's ketone, thioxanthone, benzoin butyl ether, acyloxime-ester and dibenzosuberone.

The polymerization initiator aid structure portion may be any structure portion capable of sensitizing a polymerization initiator used in combination therewith and may comprise a structure including an ordinary mono-molecular polymerization initiator aid with its atom used for bonding with another polymeric recurring structure or another bond portion. Examples of such an mono-molecular polymerization initiator aid may include: triethanolamine, Michler's ketone, 2-diethylaminobenzoic acid, 4,4'-diethylaminobenzophenone, and isoamyl 4-diethylaminobenzoate.

The bonding group portion is a structure portion originating from a group which has been introduced in advance into a mono-molecular polymerization initiator or a mono-molecular polymerization initiator aid so as to facilitate the introduction of a polymerizable group. The group introduced in advance may have any structure suited for this purpose and provides a polymerization initiator or a polymerization initiator aid having a polymeric recurring structure used in the present invention.

Thus, the polymerization initiator or polymerization initiator aid used in the present invention may be prepared by introducing a polymerizable group, such as an acryloyl group or a methacryloyl group, into a mono-molecular polymerization initiator or polymerization initiator aid optionally via a bonding group, and polymerizing the resultant polymerizable polymerization initiator or polymerization initiator aid to some extent. The resultant polymerization initiator or polymerization initiator aid may preferably have an average polymerization degree of 2–10, particularly 2–5. A polymerization initiator structure portion or a polymerization initiator aid structure portion is not required to be possessed by every recurring unit but may preferably be possessed by at least a half of the recurring units in the resultant polymerization initiator or polymerization initiator aid having a polymeric recurring structure.

In summary, the polymerization initiator or polymerization initiator aid having a polymeric recurring structure used in the present invention may be characterized by a recurring unit structure represented by the following formula (I):

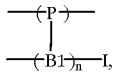

wherein P represents a recurring unit providing a polymeric recurring structure, B1 represents a bonding group portion, I represents a polymerization initiator structure portion or polymerization initiator aid structure portion, and n is 0 or 1.

In the present invention, it is preferred that P in the above formula is an acrylic recurring unit, that is the polymerization initiator or polymerization initiator aid having a polymeric recurring structure has a recurring unit structure represented by the following formula (II):

(II)

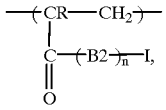

wherein B2 represents a bonding group, I represents a polymerization initiator structure portion or a polymerization initiator aid structure portion, R represents a hydrogen atom or a methyl group, and n is 0 or 1.

In the present invention, it is preferred that a polymerization initiator and a polymerization initiator aid are used in combination, and it is further preferred that both of these have a polymeric recurring structure.

Specific examples of the polymerization initiator or polymerization initiator aid preferably used in the present invention may include those having recurring units represented by the following formulae:

Formula (1):

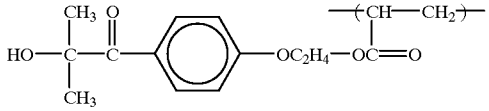

Formula (2):

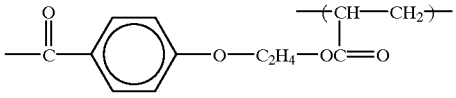

Formula (3):

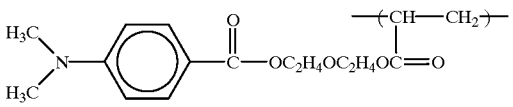

Formula (4):

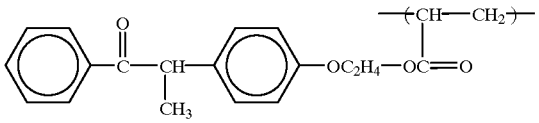

Formula (5):

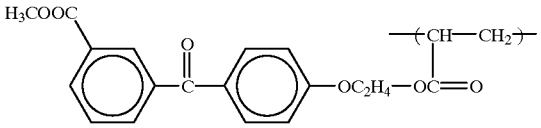

Formula (6):

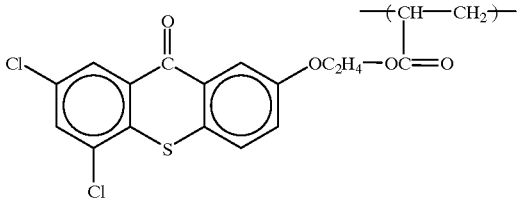

Formula (7):

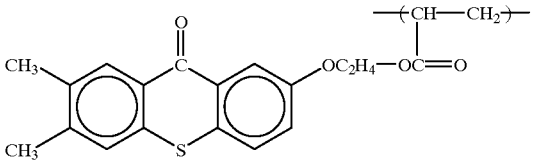

Formula (8):

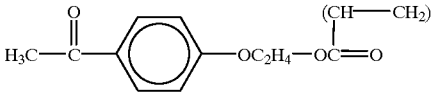

Formula (9):

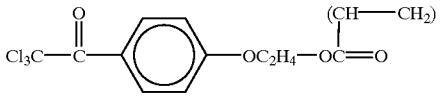

Formula (10):

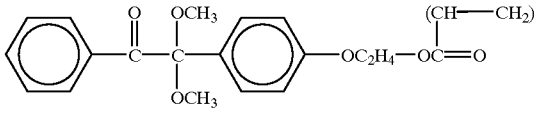

Formula (11):

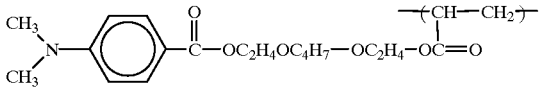

In the present invention, it is particularly preferred to use a polymerization initiator having a recurring unit of Formula (1) or (2), and a polymerization initiator aid having a recurring unit of Formula (3).

For example, a polymerization initiator having a recurring unit of Formula (2) above may be synthesized through reactions represented by the following reaction scheme. Other polymerization initiators or polymerization initiator aids may be synthesized in similar manners.

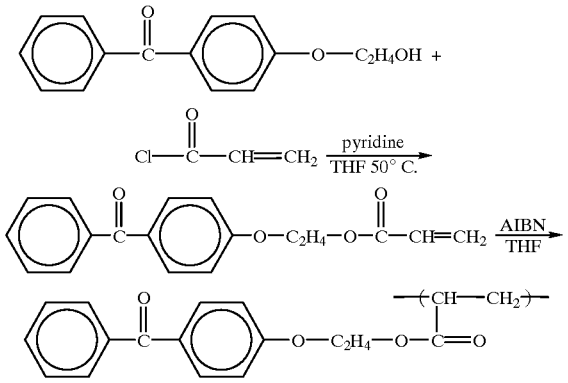

For providing the protective layer, the polymerization initiator may preferably be used in a proportion of 0.1–30 wt. %, particularly 0.5–20 wt. %, of the curable resin component, and the polymerization initiator may preferably be used in a proportion of 0.1–30 wt. %, particularly 0.5–20 wt. %, of the curable resin component. The polymerization initiator aid, when used, may preferably be used in a proportion of 20–300 mol. %, particularly 50–200 mol. %, of the polymerization initiator.

In the present invention, the polymerization initiator and the polymerization initiator having a polymeric recurring structure can respectively be used in two or more species, and can also be used in mixture with another polymerization initiator or polymerization initiator aid. Examples of such another polymerization initiator or polymerization initiator aid may include: benzophenone, Michler's ketone, thioxanthone, benzoin butyl ether, acyloxime ester, dibenzosuberone, 2-diethylaminobenzoic acid, 4,4'-diethylaminobenzophenone, and isoamyl 4-diethylaminobenzoate.

The curable resin component for providing the protective layer of the present invention may be any monomer or oligomer capable of curing through radical polymerization, and examples thereof may include: acrylic (in a sense of including "methacrylic") monomers or oligomers, liquid polybutadiene oligomers, unsaturated polyester oligomers, and polyene-polythiol oligomers. Among these, acrylic monomers or oligomers are particularly preferred in view of the reactivity and the hardness of the resultant resin.

Hereinbelow, some preferred examples of the curable resin component are enumerated by way of listing monomer structure formulae. These monomers and corresponding oligomers may preferably be used.

Formula (i):
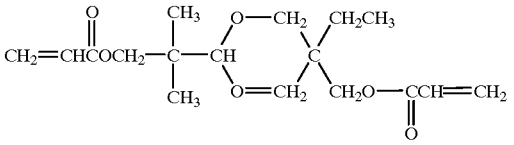
Formula (ii):
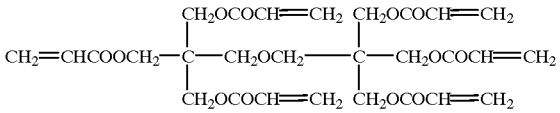
Formula (iii):
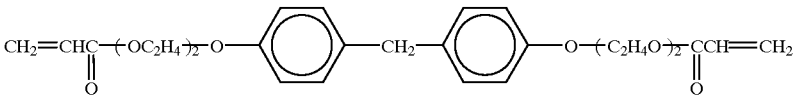
Formula (iv):
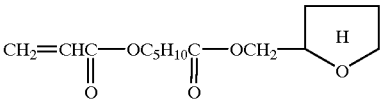
Formula (v):
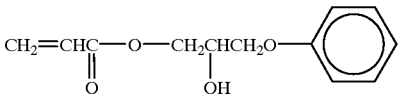
Formula (vi):
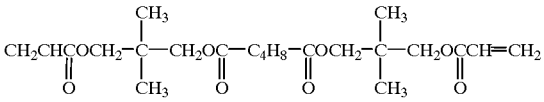
Formula (vii):
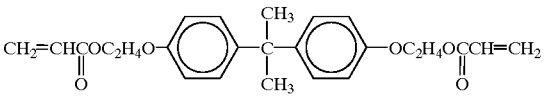
Formula (viii):
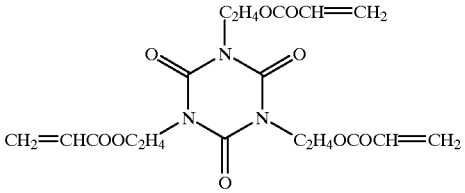
Formula (ix):
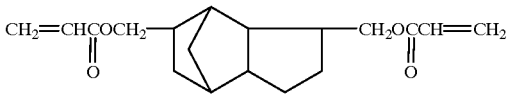
Formula (x):
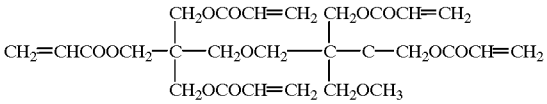
Formula (xi):
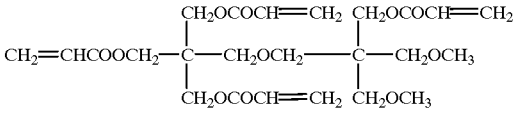
Formula (xii):
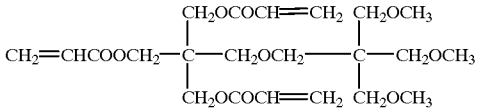
Formula (xiii):
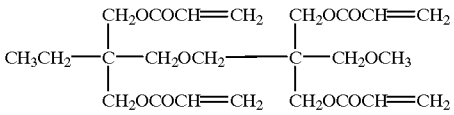

Formula (xiv):

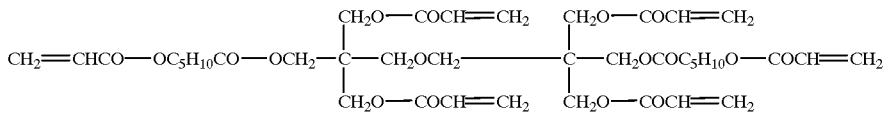

Formula (xv):

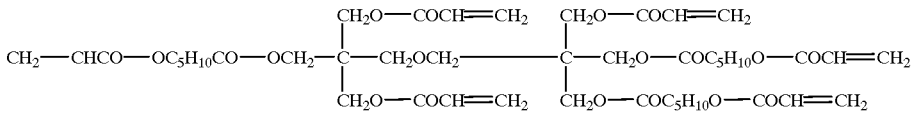

Formula (xvi):

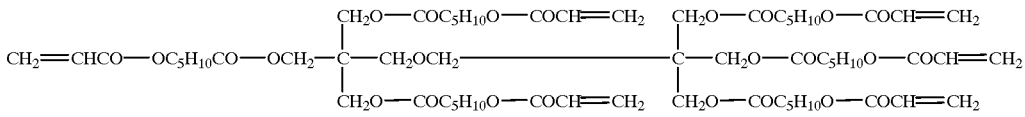

Formula (xvii)

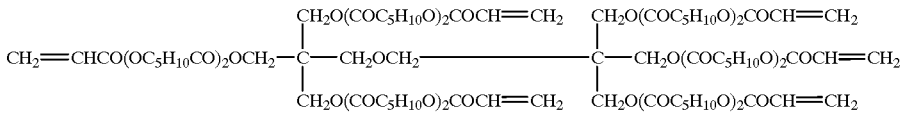

In the present invention, it is particularly preferred to use an acrylic monomer of Formula (i) or (ii), or an oligomer originating therefrom.

In formulating the binder resin for constituting the protective layer, the curable resin component can be used in combination with another resin, such as a polyester, a polycarbonate, a polyurethane, epoxy resin, silicone resin, alkyd resin, or vinyl chloride-vinyl acetate copolymer, in the form of a resin or its precursor.

In the present invention, it is preferred to incorporate electroconductive particles in the protective layer. The electroconductive particles may preferably comprise particles of an electroconductive material, specific examples of which may include: zinc oxide, titanium oxide, tin oxide, indium oxide, bismuth oxide, tin-doped indium oxide, antimony-doped tin oxide, and zirconium oxide. These metal oxide particles may be used alone or in a combination of two or more species. In the case of a combination of two or more species, the metal oxide particles may assume a form of a solid solution or melt-sticked particles. The electroconductive particles may preferably have an average particle size of at most 0.3 $\mu$m, particularly at most 0.1 $\mu$m.

In order to improve the dispersibility of the electroconductive particles and the smoothness of the protective layer and for other purposes, it is sometimes preferred to add various additives. Particularly, for the purpose of improving the dispersibility, it is very effective to surface-treat the electroconductive particles. Preferred examples of the surface-treating agent may include: fluorine-containing silane coupling agents, fluorinated silicone oils, fluorinated surfactants, and fluorine-containing graft polymers.

The content of the electroconductive particles in the protective layer is a principal factor for determining the resistivity of the protective layer and may preferably be controlled to provide a resistivity of $10^{10}$–$10^{15}$ ohm.cm of the protective layer.

In the present invention, it is preferred to incorporate fluorine-containing resin particles in the protective layer, e.g., for the purpose of improving the lubricity of the protective layer. The fluorine-containing resin particles may preferably comprise one or more species selected from tetrafluoroethylene resin, trifluorochloroethylene resin, hexafluorochloroethylene-propylene resin, vinylidene fluoride resin, difluorochloroethylene resin, and copolymers of monomers giving such resins. It is particularly preferred to use particles of tetrafluoroethylene resin or vinylidene fluoride resin. The fluorine-containing resin particles may be contained in a portion of 5–70 wt. %, particularly 10–60 wt. %, of the resultant protective layer. The molecular weight of the resin and the particle size may be appropriately selected without particular restriction.

The protective layer can further contain another additive, such as an anti-oxidant, e.g., for the purpose of improving weatherability.

The protective layer may preferably be formed in a thickness of 0.2–7 $\mu$m, particularly 0.5–5 $\mu$m.

In the present invention, it is also possible to dispose a resinous intermediate layer between the protective layer and a photosensitive layer described below.

Next, the photosensitive layer will be described. The photosensitive layer of the electrophotographic photosensitive member of the present invention may comprise a single layer containing both a charge-generating substance and a charge-transporting substance, or a laminated structure including a charge generation layer containing a charge-generating substance and a charge transport layer containing a charge-transporting substance.

The lamination type photosensitive layer will be first described.

The lamination type photosensitive layer includes a type wherein the charge generation layer and the charge-transport layer are disposed in this order on the support, and another type wherein reversely the charge transport layer and the charge generation layer are disposed in this order. In the present invention, the former type is preferred.

The support may comprise any material showing electroconductivity. For example, the support may comprise a metal or alloy, such as aluminum, copper, chromium, nickel, zinc, aluminum or stainless steel shaped into a drum form or a sheet form, a plastic film laminated with a foil of a metal, such as aluminum or copper, a plastic film coated with a vapor deposition layer of aluminum, indium oxide or tin oxide, or a substrate of a metal, plastic film or paper coated with a mixture of a metal or alloy as described above with a binder resin.

The charge transport layer may be formed by applying a solution of a charge-transporting substance together with a binder resin to form a coating layer and drying the coating layer. Examples of such a charge-transporting substance may include: polycyclic aromatic compounds having in their main chain or side chain a structure, such as biphenylene, anthracene, or phenanthrene; nitrogen-containing cyclic compounds, such as indole, carbazole, oxadiazole, and pyrazoline; hydrazones; and styryl compounds. The binder resin may for example comprise a polyester, a polycarbonate, polystyrene or a polymethacrylate ester. The charge transport layer may preferably be formed in a thickness of 5–40 $\mu$m, more preferably 10–30 $\mu$m.

The charge generation layer may be formed by applying and drying a layer of a solution of a charge generating substance together with a binder resin, or by vapor deposition of a charge-generating substance as described above, Examples of the charge-generating substance may include: azo pigments, such as Sudan Red and Dian Blue; quinone pigments, such as pyrene quinone, and anthanthrone; quinocyanine pigments; perylene pigments; indigo pigments, such as indigo and thioindigo; and phthalocyanine pigments. The binder resin may for example comprise polyvinyl butyral, polystyrene, polyvinyl acetate or acrylic resin. The charge generation layer may preferably be formed in a thickness of at most 5 $\mu$m, more preferably in a range of 0.05–3 $\mu$m.

The single layer-type photosensitive layer may be formed by applying and drying a layer of a solution containing a charge-generating substance and a charge-transporting substance as described above dispersed or dissolved therein together with a binder resin as described above. The photosensitive layer may preferably be formed in a thickness of 5–40 $\mu$m, more preferably 10–30 $\mu$m.

In the electrophotographic photosensitive member according to the present invention, it is possible to dispose an undercoating layer having a barrier function and an adhesive function between the support (or an electroconductive layer thereon) and the photosensitive layer. The undercoating layer may for example comprise a material, such as casein, polyvinyl alcohol, nitrocellulose, ethylene-acrylic acid copolymer, alcohol-soluble polyamide, polyurethane or gelatin. The undercoating layer may for example be formed in a thickness of 0.1–3 $\mu$m.

The electrophotographic photosensitive member according to the present invention can be applicable to electrophotographic apparatus in general, inclusive of copying machines, laser beam printers, LED printers, and liquid crystal shutter-type printers, and further to apparatus for display, recording, light-weight printing, plate forming and facsimile apparatus to which electrophotography is applied.

Next, a description will be provided on the process cartridge and the electrophotographic apparatus according to the present invention.

The sole FIGURE in the drawing shows a schematic structural view of an electrophotographic apparatus including a process cartridge using an electrophotographic photosensitive member of the invention. Referring to the FIGURE, a photosensitive member 1 in the form of a drum is rotated about an axis 2 at a prescribed peripheral speed in the direction of the arrow shown inside of the photosensitive member 1. The peripheral surface of the photosensitive member 1 is uniformly charged by means of a primary charger 3 to have a prescribed positive or negative potential. At an exposure part, the photosensitive member 1 is image-wise exposed to light 4 (as by slit exposure or laser beam-scanning exposure) by using an image exposure means (not shown), whereby an electrostatic latent image is successively formed on the surface of the photosensitive member 1. The thus formed electrostatic latent image is developed by using a developing means 5 to form a toner image. The toner image is successively transferred to a transfer (-receiving) material 7 which is supplied from a supply part (not shown) to a position between the photosensitive member 1 and a transfer charger 5 in synchronism with the rotation speed of the photosensitive member 1, by means of the transfer charger 6. The transfer material 7 carrying the toner image thereon is separated from the photosensitive member 1 to be conveyed to a fixing device 8, followed by image fixing to print out the transfer material 7 as a copy outside the electrophotographic apparatus. Residual toner particles remaining on the surface of the photosensitive member 1 after the transfer operation are removed by a cleaning means 9 to provide a cleaned surface, and residual charge on the surface of the photosensitive member 1 is erased by a pre-exposure means issuing pre-exposure light 10 to prepare for the next cycle. When a contact charging means is used as the primary charger 3 for charging the photosensitive member 1 uniformly, when a contact (or proximity) charging means is used, the pre-exposure means may be omitted, as desired.

According to the present invention, in the electrophotographic apparatus, it is possible to integrally assemble a plurality of elements or components thereof, such as the above-mentioned photosensitive member 1, the primary charger (charging means) 3, the developing means and the cleaning means 9, into a process cartridge detachably mountable to the apparatus main body, such as a copying machine or a laser beam printer. The process cartridge may, for example, be composed of the photosensitive member 1 and at least one of the primary charging means 3, the developing means 5 and cleaning means 9, which are integrally assembled into a single unit capable of being attached to or detached from the apparatus body by the medium of a guiding means such as a rail of the apparatus body.

Hereinbelow, the present invention will be described more specifically with reference to Examples and Comparative Examples wherein "parts" used for describing a relative amount of a component or a material is by weight unless specifically noted otherwise.

EXAMPLE 1

An aluminum cylinder of 30 mm in diameter and 260 mm in length was coated by dipping coating with a paint comprising 10 parts of tin oxide-coated titanium oxide (electroconductive pigment), 10 parts of titanium oxide (resistivity-controlling pigment), 10 parts of phenolic resin (binder) and 20 parts of methanol/methyl cellosolve (=1/1 by weight) mixture solvent, followed by heating at 140° C. for 30 min. to form a 15 μm-thick electroconductive layer.

Then, a coating liquid was prepared by dissolving 3 parts of N-methoxymethylated nylon and 3 parts of copolymer nylon in a methanol/n-butanol (=65/30 by weight) mixture solvent and applied by dipping onto the electroconductive layer, followed by drying, to form a 0.5 μm-thick intermediate layer.

Separately, a coating liquid for providing a charge generation layer was prepared by dispersing 4 parts of oxytitanium phthalocyanine showing strong peaks at diffraction angles (2↓±0.2 deg.) of 9.0 deg., 14.2 deg., 23.9 deg., and 27.1 deg. according to CuKα-characteristic X-ray diffractometry, 2 parts polyvinyl butyral ("S-LEC BM-2", available from Sekisui Kagaku K.K.) and 80 parts of cyclohexanone in a sand mill apparatus using 1 mm-dia. glass beads for 4 hours, followed by dilution with 115 parts of methyl ethyl ketone. The coating liquid was applied by dipping onto the intermediate layer and dried to form a 0.3 μm-thick charge generation layer.

Then, a solution of 10 parts of a styryl compound of the following formula:

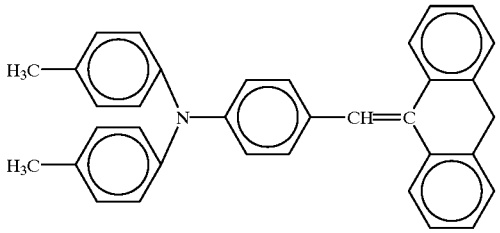

and 10 parts of polycarbonate ("IUPILON Z-200", available from Mitsubishi Gas Kagaku K.K.) in a dichloromethane/chlorobenzene (=20/60 by weight) mixture solvent, was applied by dipping onto the charge generation layer and dried under heating at 120° C. for 60 min. to form a 18 μm-thick charge transport layer.

Separately, 100 parts of antimony-containing tin oxide particles having an average particle size of 0.02 μm ("T-1", available from Mitsubishi Material K.K.), 30 parts of 3,3,3-trifluoropropyl-trimethoxysilane (available from Shin-Etsu Kagaku K.K.) and 300 parts of an ethanol/water (=95/5 by weight) mixture solvent were subjected to milling, and then the fine particles were recovered by filtration, washed with ethanol, dried and heat-treated at 120° C. for 1 hour to obtain surface-treated fine particles.

Then, 100 parts of the surface-treated antimony-containing tin oxide particles, 60 parts of an acrylic resin monomer of the before-mentioned Formula (i), 30 parts of a photo-polymerization initiator having a recurring unit represented by the before-mentioned Formula (1) (Pav (average degree of polymerization)=3) and 30 parts of a photo-polymerization initiator aid of the following formula:

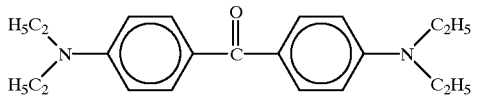

were dispersed together with 300 parts of ethanol for 96 hours in a sandmill apparatus to form a dispersion liquid, into which 100 parts of tetrafluoroethylene resin particles ("Lublon L-2", available from Daikin Kogyo K.K.) was added and dispersed for further 2 hours in the sandmill apparatus to form a coating liquid for a polymerization initiator. Then, the coating liquid was applied by dipping onto the above-formed charge transport layer and, after drying, exposed for 60 sec. to ultraviolet rays at an intensity of 160 W/cm$^2$ from a metal halide lamp to form a 3 μm-thick protective layer.

The thus-prepared electrophotographic photosensitive member was incorporated in a laser beam printer and subjected to evaluation of electrophotographic performances and a successive image formation test.

More specifically, the evaluation of electrophotographic performances was performed by using a cartridge from which a developing means and a cleaning means had been removed. First, the photosensitive member was subjected to primary charging to measure a surface potential (i.e., dark-part potential) $V_D$. Then, the photosensitive member was subjected to electrophotographic cycles (primary charging and whole-area exposure) for forming solid black images on 5 A4-size sheets, and the surface potential thereafter was measured as a light part potential $V_L$. Thereafter, the photosensitive member was further subjected to whole-area exposure with laser beam without primary charging for 4 revolutions, and the surface potential of the photosensitive member thereafter was measured as a residual potential $V_R$.

The successive image forming test was performed by incorporating the photosensitive member in an ordinary cartridge and forming A4-size halftone images (image area percentage=4%) on 10,000 A4-size sheets, whereby the image quality was evaluated with respect to the image on the finally obtained sheet by visual observation with eyes.

The results are inclusively shown in Table 1 appearing hereinafter together with those of Examples and Comparative Examples described below.

EXAMPLE 2

An electrophotographic photosensitive member was prepared and evaluated in the same manner as in Example 1 except for replacing the photo-polymerization initiator with one having a recurring unit represented by the before-mentioned Formula (2) (Pav=3).

EXAMPLE 3

An electrophotographic photosensitive member was prepared and evaluated in the same manner as in Example 1 except for replacing the photo-polymerization initiator with a compound of the following formula:

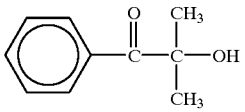

and replacing the polymerization initiator aid with one having a recurring unit represented by the before-mentioned Formula (3) (Pav=3).

EXAMPLE 4

An electrophotographic photosensitive member was prepared and evaluated in the same manner as in Example 3 except for replacing the photo-polymerization initiator with a compound of the following formula:

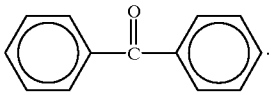

EXAMPLES 5 and 6

Electrophotographic photosensitive members were prepared and evaluated in the same manner as in Example 1 except for replacing the photo-polymerization initiator with those having recurring units represented by the before-mentioned Formula (4) (Pav=3) and Formula (5) (Pav=3), respectively.

EXAMPLE 7

An electrophotographic photosensitive member was prepared and evaluated in the same manner as in Example 3 except for replacing the photo-polymerization initiator with one having a recurring unit represented by the before-mentioned Formula (6) (Pav=2).

EXAMPLES 8 and 9

Electrophotographic photosensitive members were prepared and evaluated in the same manner as in Example 1 except for replacing the photo-polymerization initiator with those having recurring units represented by the before-mentioned Formula (8) (Pav=3) and Formula (10) (Pav=3), respectively, and also replacing the polymerization initiator aid with one having a recurring unit represented by the before-mentioned Formula (11) (Pav=3).

Example 10

An electrophotographic photosensitive member was prepared and evaluated in the same manner as in Example 4 except for replacing the photo-polymerization initiator aid with one having a recurring unit represented by the before-mentioned Formula (11) (Pav=2).

EXAMPLE 11

An electrophotographic photosensitive member was prepared and evaluated in the same manner as in Example 1 except for replacing the photo-polymerization initiator with a compound of the following formula:

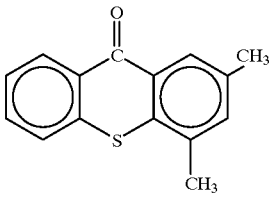

and replacing the polymerization initiator aid with one having a recurring unit represented by the before-mentioned Formula (11) (Pav=2).

EXAMPLES 12–27

Electrophotographic photosensitive members were prepared and evaluated in the same manner as in Example 1 except for replacing the acrylic resin monomer with those represented by the before-mentioned Formulae (ii)–(xvii), respectively.

Comparative Example 1

An electrophotographic photosensitive member was prepared and evaluated in the same manner as in Example 1 except for replacing the photo-polymerization initiator with a compound of the following formula:

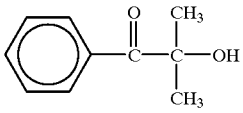

and replacing the polymerization initiator aid with a compound of the following formula:

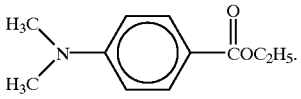

Comparative Example 2

An electrophotographic photosensitive member was prepared and evaluated in the same manner as in Comparative Example 1 except for replacing the photo-polymerization initiator with a compound of the following formula:

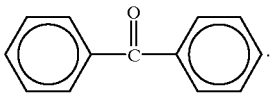

Comparative Example 3

An electrophotographic photosensitive member was prepared and evaluated in the same manner as in Comparative Example 1 except for replacing the photo-polymerization initiator with a compound of the following formula:

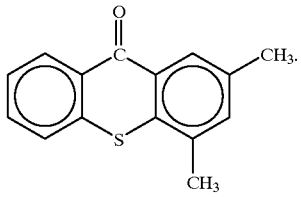

Comparative Examples 4–6

Electrophotographic photosensitive members were prepared and evaluated in the same manner as in Comparative Examples 1–3, respectively, except for replacing the photo-polymerization initiator aid used therein respectively with a compound of the following formula:

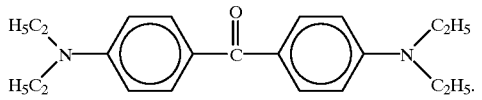

The results of the evaluation of electrophotographic performances and successive image formation test of the above-mentioned Examples and Comparative Examples are inclusively shown in the following Table 1.

TABLE 1

| | Electrophotographic performances | | | Image quality after 10,000 |
|---|---|---|---|---|
| | $V_D$ (−V) | $V_L$ (−V) | $V_R$ (−V) | sheets |
| Ex. | | | | |
| 1 | 680 | 210 | 60 | good |
| 2 | 680 | 200 | 50 | good |
| 3 | 680 | 205 | 55 | good |
| 4 | 680 | 195 | 50 | good |
| 5 | 680 | 210 | 65 | good |
| 6 | 680 | 210 | 60 | good |
| 7 | 680 | 210 | 65 | good |
| 8 | 680 | 200 | 55 | good |
| 9 | 680 | 200 | 55 | good |
| 10 | 680 | 205 | 60 | good |
| 11 | 680 | 210 | 60 | good |
| 12 | 680 | 200 | 55 | good |
| 13 | 680 | 205 | 55 | good |
| 14 | 680 | 200 | 55 | good |
| 15 | 680 | 200 | 60 | good |
| 16 | 680 | 210 | 60 | good |
| 17 | 680 | 210 | 55 | good |
| 18 | 680 | 205 | 50 | good |
| 19 | 680 | 210 | 55 | good |
| 20 | 680 | 210 | 60 | good |
| 21 | 680 | 215 | 60 | good |
| 22 | 680 | 215 | 55 | good |
| 23 | 680 | 215 | 55 | good |
| 24 | 680 | 210 | 60 | good |
| 25 | 680 | 210 | 55 | good |
| 26 | 680 | 210 | 55 | good |
| 27 | 680 | 205 | 55 | good |
| Comp. Ex. | | | | |
| 1 | 680 | 195 | 100 | image defects* |
| 2 | 680 | 200 | 110 | image defects* |
| 3 | 680 | 200 | 100 | image defects* |
| 4 | 680 | 205 | 95 | image defects* |
| 5 | 680 | 200 | 95 | image defects* |
| 6 | 680 | 200 | 100 | image defects* |

*The image on the final sheet during the 10,000 sheets of successive image forming test was accompanied with image defects attributable to damages occurred in the surface of the photosensitive member.

What is claimed is:

1. An electrophotographic photosensitive member, comprising: a support, and a photosensitive layer and a protective layer disposed in this order on the support, wherein the protective layer comprises an applied and cured product of the following solution (A) or (B):

(A) a solution comprising a curable resin component and a polymerization initiator having a polymeric recurring structure, or (B) a solution comprising a curable resin component, a polymerization initiator free from a polymeric recurring structure and a polymerization initiator aid having a polymeric recurring structure.

2. A photosensitive member according to claim 1, wherein the curable resin component is an acrylic monomer or oligomer.

3. A photosensitive member according to claim 1 or 2, wherein the polymeric recurring structure of the polymerization initiator or polymerization initiator aid includes an acrylic recurring unit.

4. A photosensitive member according to claim 1, wherein the polymeric recurring structure of the polymerization initiator or polymerization initiator aid has an average degree of polymerization of 2–10.

5. A photosensitive member according to claim 1, wherein the polymeric recurring structure of the polymerization initiator or polymerization initiator aid has an average degree of polymerization of 2–5.

6. A photosensitive member according to claim 3, wherein the polymeric recurring structure of the polymerization initiator or polymerization initiator aid has an average degree of polymerization of 2–10.

7. A photosensitive member according to claim 3, wherein the polymeric recurring structure of the polymerization initiator or polymerization initiator aid has an average degree of polymerization of 2–5.

8. A photosensitive member according to claim 1, wherein the polymerization initiator is a photo-polymerization initiator.

9. A photosensitive member according to claim 1, wherein the polymerization initiator aid is a photo-polymerization initiator aid.

10. A photosensitive member according to claim 1, wherein the solutions (A) and (B) further contain electroconductive particles.

11. A photosensitive member according to claim 10, wherein the electroconductive particles comprise a metal oxide.

12. A photosensitive member according to claim 11, wherein the polymerization initiator is a photo-polymerization initiator.

13. A photosensitive member according to claim 11, wherein the polymerization initiator aid is a photo-polymerization initiator aid.

14. A photosensitive member according to claim 1, wherein the solutions (A) and (B) further contain fluorine-containing resin particles.

15. A photosensitive member according to claim 12, wherein the solutions (A) and (B) further contain fluorine-containing resin particles.

16. A photosensitive member according to claim 13, wherein the solutions (A) and (B) further contain fluorine-containing resin particles.

17. A process cartridge, comprising: an electrophotographic photosensitive member and at least one means selected from the group consisting of charging means, developing means and cleaning means; said electrophotographic photosensitive member and said at least one means being integrally supported and detachably mountable to a main assembly of an electrophotographic apparatus, wherein said electrophotographic photosensitive member comprises a support, and a photosensitive layer and a protective layer disposed in this order on the support; and the protective layer comprises an applied and cured product of the following solution (A) or (B):

(A) a solution comprising a curable resin component and a polymerization initiator having a polymeric recurring structure, or (B) a solution comprising a curable resin component, a polymerization initiator free from a polymeric recurring structure and a polymerization initiator aid having a polymeric recurring structure.

18. An electrophotographic apparatus, comprising: an electrophotographic photosensitive member, and charging means, developing means and transfer means respectively disposed opposite to the electrophotographic photosensitive member, wherein said electrophotographic photosensitive member comprises a support, and a photosensitive layer and a protective layer disposed in this order on the support; and the protective layer comprises an applied and cured product of the following solution (A) or (B):

(A) a solution comprising a curable resin component and a polymerization initiator having a polymeric recurring structure, or (B) a solution comprising a curable resin component, a polymerization initiator free from a polymeric recurring structure and a polymerization initiator aid having a polymeric recurring structure.

* * * * *

UNITED STATES PATENT AND TRADEMARK OFFICE

CERTIFICATE OF CORRECTION

PATENT NO. : 6,004,710

DATED : December 21, 1999

INVENTOR(S) : Noriyuki TAKAGI, et al.

It is certified that error appears in the above-identified patent and that said Letters Patent is hereby corrected as shown below:

ON THE COVER PAGE

At [75], INVENTORS

"Shizuoko-ken;" should read --Sunto-gun;--.

COLUMN 1

Line 19, "subjected" should read --is subjected--.

COLUMN 3

Line 41, "an" should read --a--.

COLUMN 12

Line 28, "(-receiving)" should read --(receiving)--.

UNITED STATES PATENT AND TRADEMARK OFFICE

CERTIFICATE OF CORRECTION

PATENT NO. : 6,004,710

DATED : December 21, 1999

INVENTOR(S) : Noriyuki TAKAGI, et al.

It is certified that error appears in the above-identified patent and that said Letters Patent is hereby corrected as shown below:

COLUMN 13

Line 21, "(2⊥±0.2 deg.)" should read --(2θ±0.2 degrees)--.

Line 49, "a" should read --an--.

COLUMN 14

Line 11, "further" should read --another--.

Line 33, "with" should read --with a--.

Line 41, "with eyes" should read --by eye.--.

COLUMN 17

Line 49, "of" should read --of the--.

Line 51, "occurred in" should read --occurring on--.

Signed and Sealed this

Twenty-seventh Day of February, 2001

Nicholas P. Godici

*Attest:*

NICHOLAS P. GODICI

*Attesting Officer*

*Acting Director of the United States Patent and Trademark Office*